US005117149A

United States Patent [19]

Fijol

[11] Patent Number: 5,117,149

[45] Date of Patent: May 26, 1992

[54] PARALLEL PLATE ELECTRON MULTIPLIER WITH NEGATIVELY CHARGED FOCUSSING STRIPS AND METHOD OF OPERATION

[75] Inventor: John J. Fijol, Longmeadow, Mass.

[73] Assignee: Galileo Electro-Optics Corporation, Sturbridge, Mass.

[21] Appl. No.: 521,017

[22] Filed: May 9, 1990

[51] Int. Cl.[5] ..... H01J 43/14; H01J 43/00

[52] U.S. Cl. ..... 313/103 R; 313/104; 313/105 R

[58] Field of Search ..... 313/103 R, 104, 105 R

[56] References Cited

U.S. PATENT DOCUMENTS

| | | | |
|---|---|---|---|
| 2,130,152 | 9/1938 | Perkins | 313/104 |
| 2,841,729 | 7/1958 | Wiley | 313/104 |
| 2,932,768 | 4/1960 | Wiley | 313/104 |
| 3,128,408 | 4/1964 | Goodrich et al. | 313/103 R |
| 3,244,922 | 4/1966 | Wolfgang | 313/103 R |
| 3,483,422 | 12/1969 | Novotny | 313/105 R |
| 3,634,713 | 1/1972 | Foote | 313/103 R |
| 3,675,063 | 7/1972 | Spindt et al. | 313/104 |
| 3,757,157 | 9/1973 | Enck, Jr. et al. | 313/103 R |
| 3,808,494 | 4/1974 | Hayashi et al. | 313/103 R |
| 4,115,719 | 9/1978 | Catanese et al. | 313/105 R |

OTHER PUBLICATIONS

"Applied Electromagnetism" second edition, Shen and Kong, 1987, p. 255.

*Primary Examiner*—Donald J. Yusko
*Assistant Examiner*—Brian Zimmerman
*Attorney, Agent, or Firm*—Watson, Cole, Grindle & Watson

[57] ABSTRACT

A parallel plate electron multiplier employing active dynode surfaces in confronting spaced relationship for effecting electron multiplication between the input and the output thereof in the active dynode area. Electron multiplication occurs in response to an accelerating biasing field extending between the input and the output. Electrostatic elements laterally of the dynode area establish lateral biasing fields in a direction transverse of the dynodes for containing electrons in the dynode area and for attracting positively charged species away from the dynode area in order to reduce spurious signals.

25 Claims, 4 Drawing Sheets

Fig. 6.
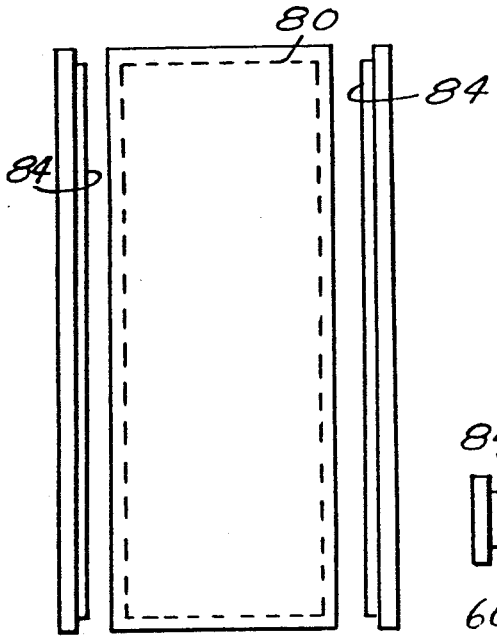
Fig. 7.
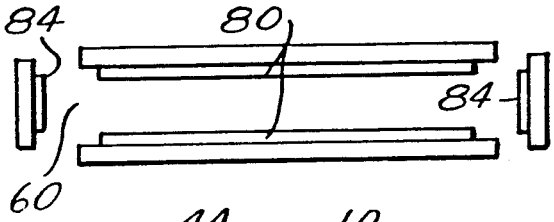
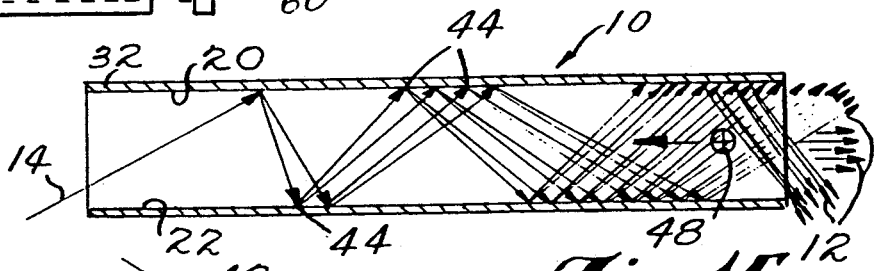
Fig. 15.
(PRIOR ART)
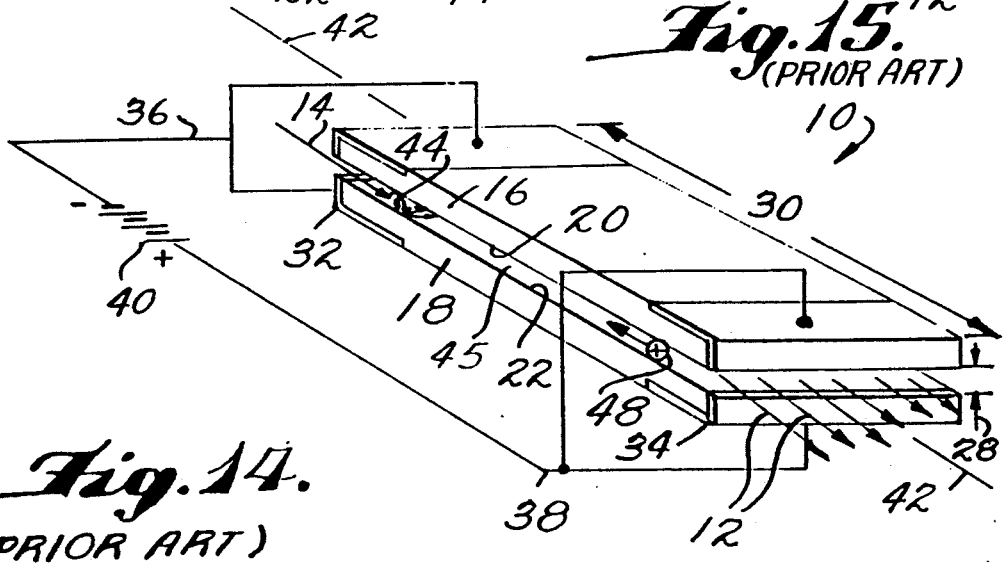
Fig. 14.
(PRIOR ART)

PARALLEL PLATE ELECTRON MULTIPLIER WITH NEGATIVELY CHARGED FOCUSSING STRIPS AND METHOD OF OPERATION

BACKGROUND OF THE INVENTION

The invention relates to parallel plate electron multipliers. In particular, the invention relates to such devices employing electrostatic fields for containing the electron cloud and for reducing ion feedback.

A continuous dynode parallel plate electron multiplier (PPM) 10 illustrated in FIGS. 14 and 15 creates a detectable electron avalanche 12 when stimulated by a photon or an energetic charged particle 14. In the device shown, a pair of parallel plates 16–18 carry dynodes 20–22 formed thereon of a suitable material with an appropriate resistance and secondary electron yield. The dynode material is uniformly distributed on the confronting parallel surfaces of the plates 16, 18 so that the active portions of the dynodes 20–22 face each other.

The plates 16–18 are separated by a gap (G) 28 and the device 10 has a length (L) 30 from its input end 32 to its output end 34. The ratio of L over G is about 20:1 or better for satisfactory electron multiplication output.

Electrical connections 36–38 are made from a high voltage supply (40) between the input end 32 and the output end 34 of the dynodes 20 and 22 as shown. The high voltage supply 40 biases the front of the device 10 negatively with resistance in the semiconducting range experience electrical conduction down the length of the device thereby creating a uniform gradient in potential down the center axis 42 of the PPM. In the simplified illustration of FIG. 15, a sufficiently energetic photon or charged particle 14 impinging on the dynode 22 at input end 32 of the PPM 10 causes secondary electrons 44 to be emitted from the dynode 22 at the point of the impact. These secondary electrons 44 are typically emitted with some energy in the direction normal to the surface of the dynode 22. The initial energy causes secondary electrons 44 to travel across the gap 28 between the plates 16–18. Simultaneously, the electrons are accelerated down the length of the device 10 under the influence of the electric field produced by the high bias voltage 40. The electrons continue to accelerate until they strike the opposite dynode 20. Bias voltages, plate spacing and emissive dynode layers are chosen so that the electrons gain sufficient impact energy to create an average number of secondary electrons greater than 1. Each new electron is accelerated away from its origin until it strikes an opposing dynode. This process repeats itself as the electrons progress down the length of the device. The number of electrons in the cascade increases geometrically with each strike resulting in an electron avalanche 12 at the output end 34.

Although parallel plate electron multipliers have a relatively simple configuration and may be processed using less complicated techniques, PPMs have a number of problems which discouraged their implementation. Of particular concern are the containment of the electron avalanche between dynode surfaces and ion feedback. With respect to containment, as the electron density increases, the repulsive force between the secondary electrons tends to direct them out the open sides 46 of the dynode region (FIG. 14). This limits the size of the charge cloud and the gain of the multiplier. With respect to ion feedback, the increasing avalanche of secondary electrons 44 near the output end 34 of the device enhances the probability of ionizing residual gas or stimulating desorption of ionized species 48 from the dynode surfaces 20 and 22 (FIG. 15). These ions are accelerated towards the input end 32 where they can strike the dynode surfaces and generate a new electron avalanche. This phenomenon is referred to as ion feedback and has a deleterious effect on the signal-to-noise ration of the device.

In channel electron multipliers, that is devices formed in tubular or capillary configuration, these problems are corrected by the geometry of the device, where the capillary channel serves to contain the electron cloud. Further, curvature of the channel forces ions to collide with the channel wall close to the output end of the device thereby reducing the size of the resulting ion feedback pulses. However, CEMs often require more complex processing and are often too large for a particular application.

SUMMARY OF THE INVENTION

In accordance with the present invention, the aforementioned problems may be eliminated in a parallel plate multiplier (PPM) by employing electrostatic potentials instead of geometric constrains to contain the electron cloud and to eliminate or significantly reduce ion feedback.

The invention comprises a parallel plate electron multiplier employing active dynode surfaces in confronting spaced relationship for effecting the electron multiplication between the input and output thereof in an area defined between the active dynode surfaces. Electron multiplication occurs in the presence of a biasing field extending between the input and the output. Importantly, electrostatic elements laterally of the dynode area establish biasing fields in a direction transverse of the dynodes for containing electrons in the dynode area and for attracting positively species away from the dynode area in order to reduce spurious signals In one embodiment of the invention the electrostatic elements comprise a pair of focusing strips adjacent the dynode in a plane parallel therewith. In other embodiments the dynodes are shaped so that inputs and outputs are offset.

BRIEF DESCRIPTION OF THE DRAWINGS

FIG. 6 is a plan view of an electron multiplier according to another embodiment of the invention;

FIG. 7 is an end view of the embodiment of FIG. 6;

FIG. 14 is a fragmented perspective schematic illustration of a known parallel plate electron multiplier PPM; and FIG. 15 is a simplified schematic illustration showing electron multiplication in the known device of FIG. 14.

DESCRIPTION OF THE INVENTION

Figure 1:
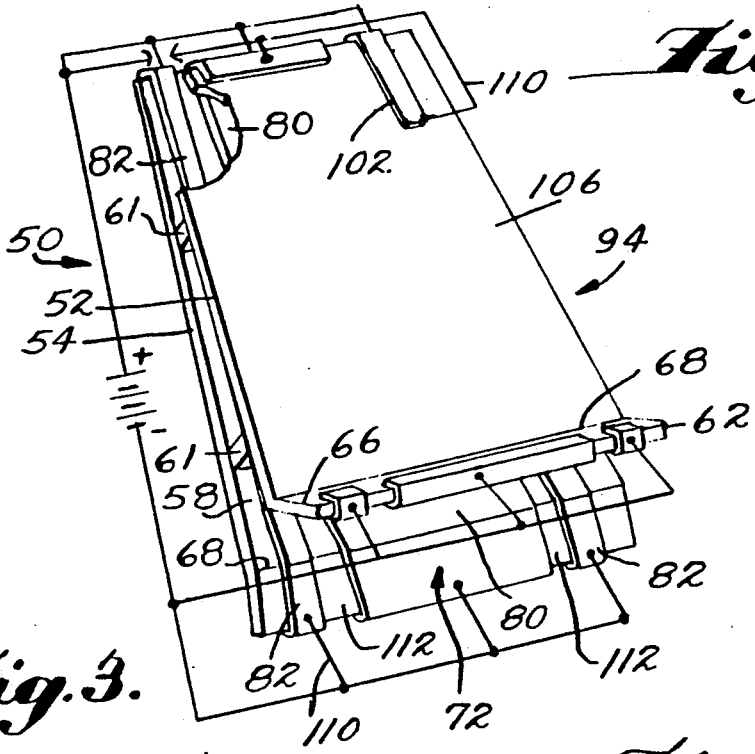
FIG. 1 is a fragmented perspective view of an electron multiplier according to the present invention.
Figure 3:
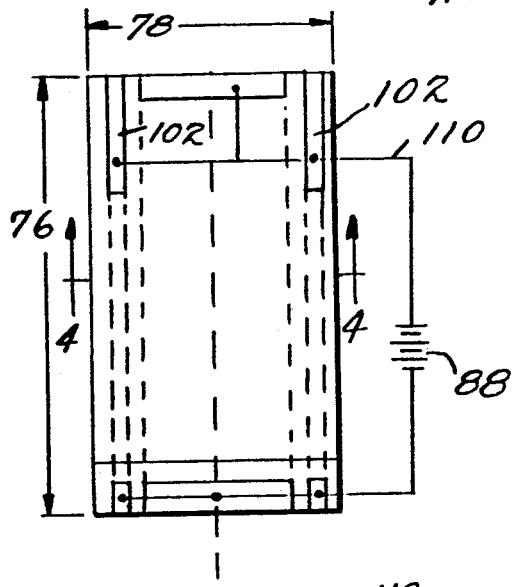
FIG. 3 is a plan view of the electron multiplier illustrated in FIG. 1.
Figure 4:
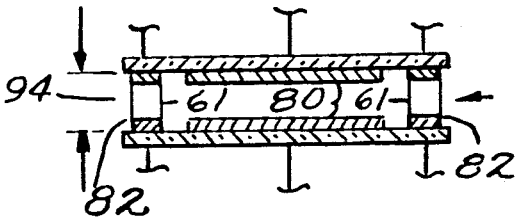
FIG. 4 is a cross-sectional view of the electron multiplier taken along line 4—4 of FIG. 3.
Figure 2:
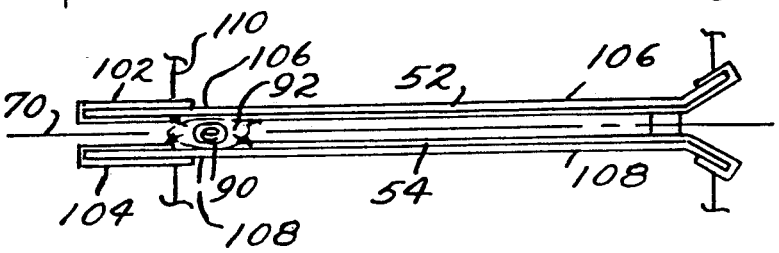
FIG. 2 is a side view of the electron multiplier shown in FIG. 1.

FIGS. 1-4 illustrate an electrostatically focused parallel plate electron multiplier (EEPPM) 50 in accordance with one embodiment of the present invention. A pair of generally planar parallel plates 52-54 of thickness (t) and generally rectangular configuration have confronting surfaces 56 and 58 in parallel spaced relationship separated by gap (G) 60. The gap is maintained by ceramic spacers 61. The input end 62 and 64 of each plate 52 and 54 is bent at an angle 66 along the line 68 which is perpendicular to a central axis of the device.

The device 50 extends from its input 72 to its output 74, a length (L) 76. In accordance with the invention the ratio L/G may be as low 20:1. Preferably, however, the ratio L/G is about 50:1 when the device 50 is operated in the analog mode and the ratio L/G is about 75:1 when operating in the pulse counting mode. The device 50 has a width dimension (W) 78 as shown. In an exemplary embodiment, hereinafter referred to, preferred dimensions and parameters are set forth.

In the arrangements illustrated in FIGS. 1-4 and 5, each of the plates 52 and 54 have a central dynode 80 and laterally disposed semiconducting focusing field strips 82. The simple rectangular geometry and biasing arrangement for one plate 54 is shown schematically in FIG. 5. When suitably energized as described hereinafter the field strips 82 produce opposed electric fields E which focus electron within the dynode area 80 during the multiplication process. Except at the input end 72, the field strips 82 are negatively biased with respect to the dynode 80. It is to be understood that the other plate 52 is biased in a similar manner, although not necessarily in an identical manner.

Figure 5:
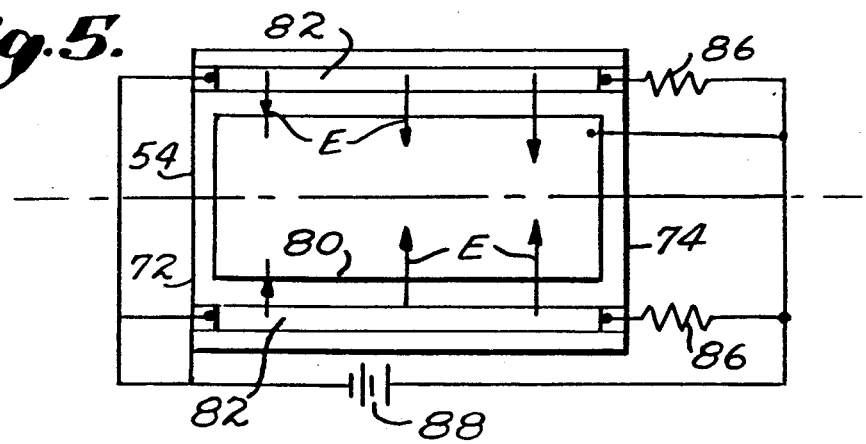
FIG. 5 is a plan view of one plate of the electron multiplier according to the invention.

In FIG. 5 dropping resistors 86 are coupled to the field strips 82 at the output end 74 of the substrate 54. The resistors 86 are connected in series with the field strips 82 between the output end 74 of the multiplier and the positive side of the high voltage source 88 as shown. The dynode 80 is connected at the output end of the device directly to the high voltage source 88 as shown without a dropping resistor in series. At the input end 72 the dynode 80 and each of the field strips 82 are directly connected to the negative side of the high voltage source 88. Each dropping resistor 86 forms a voltage divider with the corresponding field strips 82 to thereby satisfy the requirement that each field strip 82 has a more negative potential along its length than the dynode 80.

During operation, the electrons 90 form a dense cloud 92 (FIG. 2) of negatively charged particles. The electrons 90 are accelerated perpendicular (e.g. laterally) to the center axis 70 of the dynode 80 to escape out the sides 94 of the device 50.

The energy achieved by the electrons 90 in the lateral direction perpendicular to the axis 70 is relatively small in comparison to the energy gained axially due to the bias voltage 88. Accordingly, a relatively small potential difference between the dynode 80 and the field strips 82 will be sufficient to contain the charge cloud 92.

Figure 8:
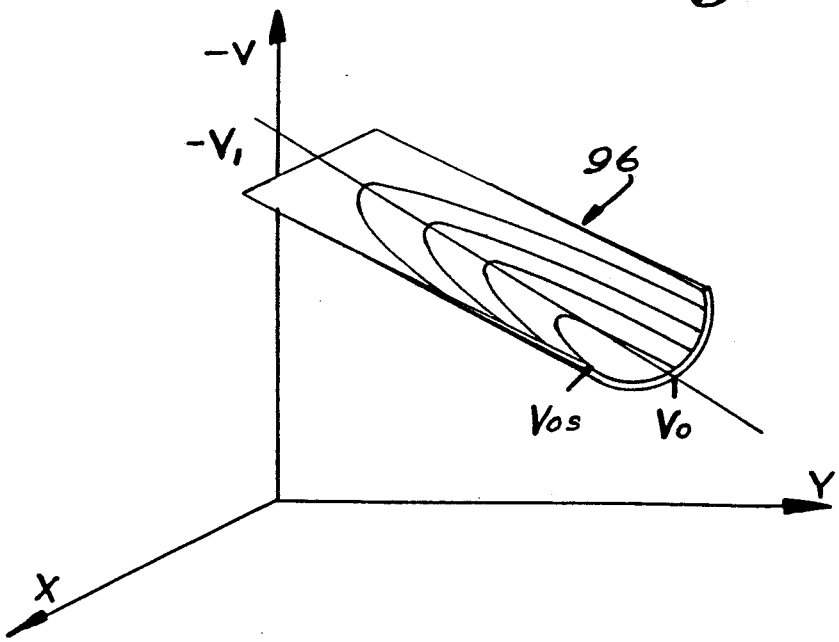
FIG. 8 is an illustration of a potential trough created on a single plate of the electrostatically focused electron multiplier illustrated in FIG. 5.

The bias potentials that are applied to the field strip 82 and dynode 80 provide a potential trough 96 of increasing height along the length of the device 50 as illustrated in FIG. 8. The relatively high negative voltage $V_I$ is the bias voltage applied to the input 72 of the dynode 80 and the field strips 82. The voltage $V_O$ represents the voltage applied to the output end of the dynode 80. The voltage $V_{OS}$ represents the extremities of the trough 96, which also represents the voltage applied to the output end 74 of the focusing strips 82. The difference $V_{OS}$ minus $V_O$, resulting from the dropping resistors 86, is the energy threshold necessary for the electrons 90 to escape out the sides of the device at the output end 74. The threshold increases lengthwise with the device from the input to the output as the density of electrons in the charge cloud increases. In accordance with the invention the bias potentials that are applied to the field strips 82 with respect to the dynodes 80 result in forces which contain and cause the electrons to be focused towards the fall line of the potential trough 96.

At the same time any positive ions, produced as a result of an ionization process near the output end 74, are accelerated in an opposite direction to electrons. In other words, the same potential trough 96 which focuses the electron cloud 92 toward the center of the dynode region 80 simultaneously accelerates ions out the sides 94 of the device 50. In effect, the arrangement of the present invention eliminates ion feedback by preventing an energetic collision of the ion with the dynode 80 near the input end 72.

In the biasing arrangement described, the field strips 82 themselves form continuous dynode multipliers if the secondary electron yield as a strip material is greater than 1. However, by tailoring the values of dropping resistors 86 the bias potentials may be manipulated thereby slanting equipotential lines between the opposing plates 52 and 54. If the equipotential lines are sufficiently slanted the electrons will be forced to collide with the field strips with such low energies that the secondary yield is less than 1. Two different resistor values in series with the field strips on the plates 52 versus 54 cause this to occur. In other words, in FIG. 5 the dropping resistors 86 associated with the plate 54 has a given resistance whereas the dropping resistors (not shown in FIG. 5) associated with the opposite plate 52 may have different values. This prevents the formation of an electron avalanche in the field strip regions.

In an exemplary embodiment such as shown in FIGS. 1-4, a particular device was prepared employing a pair of parallel plates 52, 54 held in spaced configuration by ceramic washers 61. The dropping resistors in the example are formed of resistive material (trimmed semiconductive dynode material) 102 and 104 formed on the external surfaces 106 and 108 of the respective plates 52 and 54. Leads or electrodes 110 were bonded to the device 50 as shown and to the high voltage supply. In the arrangement a gap 112 separates the dynode 80 from the field strips 82.

EXAMPLE

| | |
|---|---|
| Plates 52-54: | Lead Silicate Glass |
| Length (L): | 2.3" |
| Width (W): | 1.0" |
| Thickness (t): | 0.2" |
| Finish: | 80/50 scratch/dig |
| Flatness: | 10 fringes/in |
| Flare angle 66: | 45 |
| Flare Length: | 0.3" |
| Dynode 80: | 0.5" w × 2.3" l hydrogen reduced lead silicate glass |
| Field Strip 82: | 0.1" w × 2.3" l hydrogen reduced lead silicate glass |
| Dynode/Field Strip Gap 112: | 0.1" w × 2.3" l produced by sand blasting reduced |

-continued

| |
|---|
| lead silicate layer |

Dynode material extends around plate end portions onto external surfaces.

Dropping resistors 102–104 for plates 52–54 formed of the selected dynode material selectively trimmed to length to achieve desired value.

| | |
|---|---|
| Electrodes 110: | Bonded with silver paint |
| Total parallel resistance: | $10^7$ ohms |
| Spacers (61): | ceramic washers |
| L/G | 75:1 pulse counting mode<br>50:1 analog mode<br>20:1 min |
| HV | 0–4000 v |
| Gain-Pulse counting mode: | $10^{10}$ @ 3300 V, $10^3$ counts/sec<br><35% FWHM |
| Analog gain: | $10^6$ with 1 pA beam argon atoms input |

It is also possible to use focusing or field strips 84 formed on separate substrates 85 on each side of the dynodes 80 as illustrated in the alternative embodiment of FIGS. 6 and 7. The field strips 84 are perpendicular to the dynodes 80 and more or less bridge the gap 60 at the sides of the device. However, the arrangement of FIGS. 1–4 and 5 is preferred for most applications because the focusing 82 and the dynode 80 may be formed on a single substrate as shown which simplifies the design and manufacture of the device.

Figure 9:
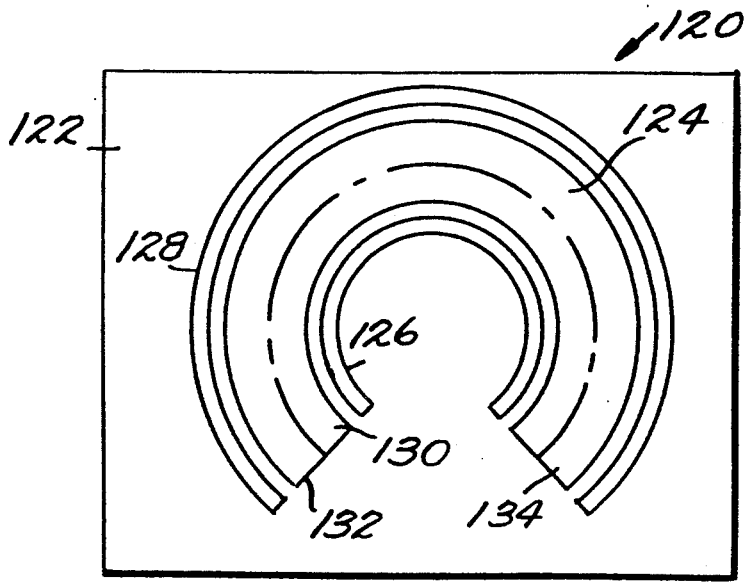

Other embodiments of the invention include arrangements illustrated, for example, in FIGS. 9–13. In FIG. 9 a portion (one plate) of a parallel plate electron multiplier 120 is shown. In the arrangement, Plate 122 carries a C-shaped dynode 124 and concentric inner and outer field strips 126 and 128. The axis of the device is a circle 130 concentric with the dynode 124. It should be understood that in the embodiment described in FIG. 9 a lesser or greater portion of a circular device may be employed and the device may be used in combination with other devices to fan out the input 132 with respect to the output 134.

Figure 10:
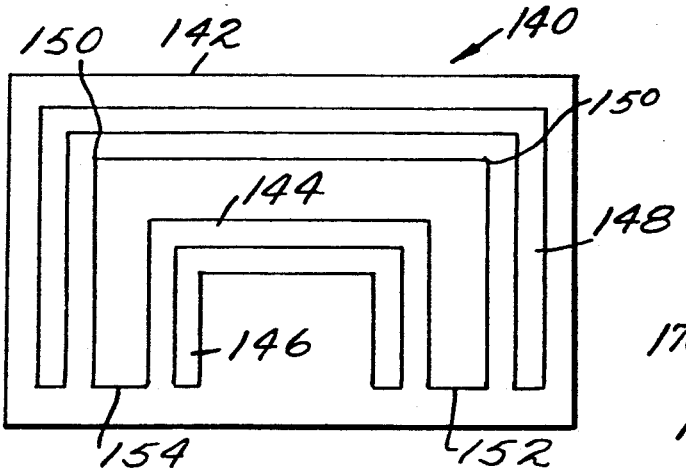
Figure 12:
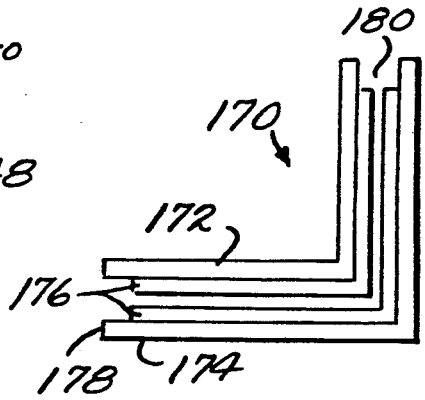
Figure 11:
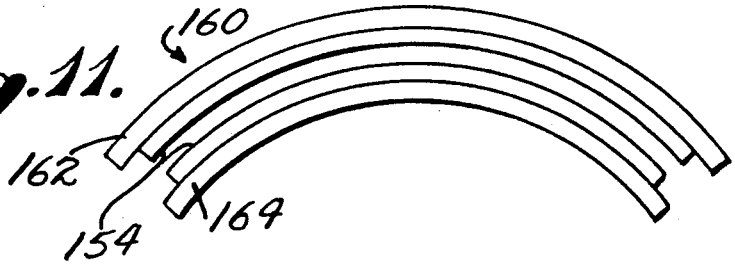

In FIG. 10 a portion of a device 140 is illustrated in which the plate of substrate 142 carries a dynode 144 and inner and outer field strips 146, 148. In the arrangement of FIG. 10 the dynode 144 makes abrupt right angle turns at the corners 150 to reverse the direction of the input 152 with respect to the output 154. In FIG. 11 a device 160 is illustrated in side elevation in which the plates 162, 164 are a pair of opposed concentrically formed surfaces 162, 164 carrying dynodes (not visible in the side view) and field strips 154 thereon. In the arrangement of FIG. 12 the device 170 employs a pair of plates 172–174 which are bent as shown at right angles and carry the dynodes (not visible in the side view) and field strips 176. The arrangement allows the input 178 to be offset at right angles to the output 180.

Figure 13:
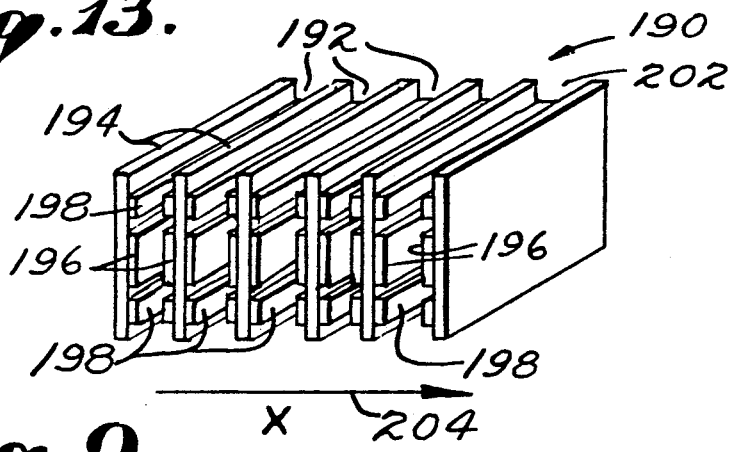
FIGS. 9–13 illustrate various alternative embodiments of the present invention.

In FIG. 13 an electron multiplier array 190 is formed of a plurality of parallel plate electron multipliers 192 arranged in side by side configuration. In the arrangement the substrates or plates 194 each carry a dynode 196 and lateral focusing strips 198 from the input 200 to the output 202. In the embodiment shown in FIG. 13 the plurality of electron multipliers 192 allows for spacial resolution in the X direction illustrated by the arrow 204. Such a device is useful for mass spectrometry where the trajectory of the incoming particle may be affected by its mass. Accordingly, the detection of the particle in a particular one of the electron multipliers 192 provides a general determination of its mass and hence its possible composition.

In the various embodiments illustrated herein the dynodes are formed of reduced lead silicate glass. In other embodiments the dynodes may be formed by deposition of current carrying and electron emissive films. Such films may be formed, for example, by evaporation, sputtering or chemical vapor deposition onto a dielectric substrate. Exemplary conductive films include undoped Si, P-doped Si, O-doped Si ($SiO_x$), and N-doped Si ($SiN_x$). Exemplary emissive films include $SiO_2$, $Si_3N_4$, MgO, $Al_2O_3$, and BaO. Exemplary planar substrates may include $SiO_2$ glass, $Al_2O_3$ and AlN. In addition, the emissive layer may be formed by growth of a dielectric film upon an underlying semiconductive metal layer, for example, $SiO_2$ or $Si_3N_4$ on Si or by liquid phase deposition of a dielectric films such as $SiO_2$.

The pattern for the dynode and field strips may also be accomplished in any of the various arrangements by photolithographic techniques. It should be understood that the scale of the electrostatically focused parallel plate electron multiplier of the present invention may vary greatly. For example, a dynode $60\times10$ millimeters with a 0.5 millimeter gap may be provided on the macroscopic level. Further, microscopic arrangements may be employed in which the dynode is $600\times100$ microns with a 5 micron gap. The resulting L/G being essentially unchanged and thereby supporting electron multiplication.

While the invention has been described in connection with specific embodiments thereof, it will be understood that it is capable of further modifications. This application is intended to cover any variations, uses or adaptations of the invention following, in general, the principles of the invention, and including such departures from the present disclosure as come within known and customary practice within the art to which the invention pertains.

What is claimed is:

1. A parallel plate electron multiplier comprising:

active dynode surfaces in confronting spacial relationship having lateral margins defining a dynode region therebetween producing when energized an increasing potential gradient for effecting electron multiplication in a first direction along an axis extending from an input end to an output end; and elongated semiconductor means disposed adjacent the lateral margins of the dynode surfaces extending in the first direction and being electrically isolated from the dynode surfaces for producing when energized an increasing potential gradient therealong relatively more negative than the increasing potential gradient of the dynode surfaces for establishing opposing biasing fields in a direction laterally of the dynode region transverse of first direction for extracting positive species from the dynode region and confining electrons therein.

2. An electron multiplier having an input and an output comprising:

dynode surfaces in spaced apart confronting relationship extending between the input and the output having lateral margins defining a dynode area for effecting electron multiplication therebetween lengthwise from the input to the output in response to a lengthwise biasing field of increasing potential gradient; and biasing means in the form of continuous strips one each extending lengthwise between the input and the output along adjacent lateral margins of the dynode area being isolated therefrom and having a resistance characteristic for establishing biasing fields laterally opposed to each other, said biasing fields for containing electrons within the dynode area and for attracting positive species which may be produced during electron multiplication, said biasing fields having an increasing potential gradient relatively less than the increasing potential gradient for the field of the adjacent dynode.

3. A method of operating a parallel plate electron multiplier in which opposed spaced apart dynodes under the influence of a biasing field extend in a first direction from input to an output thereof, said biasing field for supporting electron multiplication in said direction comprising the step of: establishing a confining biasing field of increasing potential relatively more negative than the biasing field, said confining biasing field extending in a second direction laterally of the first direction for confining electrons to a region between the dynodes.

4. A parallel plate electron multiplier comprising opposed spaced apart dynodes having lateral margins for effecting electron multiplication therebetween in a first direction between an input and an output thereof and biasing means extending in the first direction for establishing a biasing field in a second direction laterally of the first direction for extraction of positive species and confinement of electrons, the biasing means comprising focusing strips aligned laterally of the dynodes being symmetrically biased negatively relative to the dynodes and having a potential gradient less than an increasing potential gradient for the adjacent dynode.

5. A parallel plate electron multiplier comprising:

opposed spaced apart dynodes having lateral margins for effecting electron multiplication therebetween in a first direction between an input and an output thereof and elongated biasing means comprising at least one pair of focusing strips each running lengthwise of the dynodes and extending in the first direction adjacent the lateral margins of the dynodes for establishing a biasing field in a second direction laterally of the first direction, said biasing field having a potential gradient relatively more negative than an increasing potential gradient of the dynodes for extraction of positive species and confinement of electrons.

6. The electron multiplier of claim 5 wherein the biasing means are continuous.

7. The electron multiplier of claim 5 wherein the biasing means comprise a pair of parallel opposed surfaces.

8. The electron multiplier of claim 5 wherein the biasing means are semiconductive surfaces.

9. The electron multiplier of claim 5 wherein the biasing means comprise at least one pair of focusing strips, each one running lengthwise of the dynodes at opposite lateral margins thereof between the input and the output.

10. The electron multiplier of claim 9 wherein the focusing strips are in a plane perpendicular to the dynodes.

11. The electron multiplier of claim 9 wherein the focusing strips are in a plane parallel to each dynode.

12. The electron multiplier of claim 9 wherein the biasing means include resistive element means serially coupled to the focusing strips near the output of the electron multiplier.

13. The electron multiplier of claim 5 wherein the dynodes extend in a nonlinear path between the input and the output such that said input and output are offset with respect to each other.

14. The electron multiplier of claim 5 wherein the dynode is curvilinear.

15. The electron multiplier of claim 5 wherein a plurality of said spaced apart dynodes provides spacial resolution in a direction perpendicular to a central axis of each electron multiplier and the biasing field.

16. The electron multiplier of claim 5 wherein the plates are uniformly spaced apart about a center.

17. The electron multiplier of claim 5 wherein the plates are uniformly spaced apart and the input and output are in different planes.

18. The electron multiplier of claim 5 wherein the dynodes have a lengthwise dimension (L) and are spaced apart forming a gap (G) therebetween wherein the ratio of L/G is at least 20:1.

19. The electron multiplier of claim 18 wherein the ratio of L/G is between 50:1 and 100:1.

20. The electron multiplier of claim 5 wherein the dynodes are supported mechanically by substrate materials selected from the group consisting of lead silicate glass, $SiO_2$, $Al_2O_3$ and AlN.

21. The electron multiplier of claim 5 wherein the dynodes are comprised of materials selected from a group consisting of lead silicate glass, undoped Si, P-doped Si, O-doped Si ($SiC_x$), N-doped Si ($SiN_x$), $SiO_2$, $Si_3N_4$, MgO, $Al_2O_3$, and BaO.

22. The electron multiplier of claim 5 wherein dynodes are formed by at least one of reduction of lead silicate glass, liquid phase deposition, oxidation, nitriding, evaporation, sputtering, and chemical vapor deposition.

23. The electron multiplier of claim 5 wherein the dynodes and focusing strips comprise films photolithographically deposited on substrates forming opposed parallel plates.

24. The electron multiplier of claim 23 wherein the biasing means for the focusing strips comprise resistive portions of the films being selectively trimmed to a length for establishing a resistance thereof different from the dynodes and being energizable near the output for producing the confining biasing field.

25. The electron multiplier of claim 5 wherein the biasing means is laterally spaced from the dynodes and provides a separate electrically isolated current path therefrom.

* * * * *